US007097522B1

(12) United States Patent
Scherer, III et al.

(10) Patent No.: US 7,097,522 B1
(45) Date of Patent: Aug. 29, 2006

(54) WATER PICKUP CONFIGURATION FOR A MARINE PROPULSION SYSTEM

(75) Inventors: John O. Scherer, III, Oshkosh, WI (US); Gary J. Schaub, North Fond du Lac, WI (US); Jay P. Dehling, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/218,459

(22) Filed: Sep. 2, 2005

(51) Int. Cl.
*B63H 20/28* (2006.01)

(52) U.S. Cl. ..... 440/88 M; 440/76

(58) Field of Classification Search ..... 440/76, 440/88 M

See application file for complete search history.

(56) References Cited

U.S. PATENT DOCUMENTS

| | | | | | |
|---|---|---|---|---|---|
| 1,099,684 | A | * | 6/1914 | Barlow et al. | 440/88 M |
| 2,089,366 | A | * | 8/1937 | Hansen | 440/76 |
| 2,536,374 | A | * | 1/1951 | Kincannon | 418/46 |
| 2,549,477 | A | * | 4/1951 | Kiekhaefer | 440/78 |
| 2,656,812 | A | * | 10/1953 | Kiekhaefer | 416/93 R |
| 2,684,635 | A | * | 7/1954 | Winkelman et al. | 415/116 |
| 4,752,257 | A | | 6/1988 | Karls et al. | 440/76 |
| 4,767,366 | A | | 8/1988 | Lang | 440/76 |
| 4,832,635 | A | | 5/1989 | McCormick | 440/78 |
| 4,861,293 | A | | 8/1989 | McGowan et al. | 440/76 |
| 4,954,109 | A | | 9/1990 | McMorries, IV | 440/78 |
| 5,098,322 | A | | 3/1992 | Higby | 440/88 |
| 5,215,487 | A | | 6/1993 | Gruber | 440/88 |
| 5,340,345 | A | | 8/1994 | Brodbeck et al. | 440/88 |
| 5,376,031 | A | | 12/1994 | Meisenburg et al. | 440/76 |
| 5,536,188 | A | | 7/1996 | Porta | 440/78 |
| 5,766,046 | A | | 6/1998 | Ogino | 440/78 |
| 5,772,481 | A | | 6/1998 | Alexander et al. | 440/66 |
| 6,146,223 | A | | 11/2000 | Karls et al. | 440/88 |

* cited by examiner

*Primary Examiner*—Ed Swinehart
(74) *Attorney, Agent, or Firm*—William D. Lanyi

(57) ABSTRACT

A cooling system for a marine propulsion device provides a water flow directing device, which is generally annular in shape, which has a water inlet extending from it. The water flow directing device is attachable to a gear case of a marine propulsion device and is configured to conduct a flow of water from a water inlet to a passage formed within the marine propulsion device and connected in fluid communication with a water pump that causes the water to flow to a cooling system of an internal combustion engine. The water flow directing device is removably attachable to a seal carrier which, in turn, is attachable to a bearing carrier disposed within an internal cavity of the gear case. A secondary inlet is provided through a surface of the gear case and in fluid communication with an internal annular passage of the water flow directing device to encourage a flow of water into the cooling system when the marine propulsion device is operating at slow speeds or is stationary in a body of water.

20 Claims, 5 Drawing Sheets

WATER PICKUP CONFIGURATION FOR A MARINE PROPULSION SYSTEM

BACKGROUND OF THE INVENTION

1. Field of the Invention

The present invention is generally related to a cooling system for a marine propulsion device and, more particularly, to a removable aft-mounted water pickup device that locates the water pickup at a position behind and below a gear case of the marine propulsion device.

2. Description of the Related Art

Those skilled in the art of marine propulsion systems are familiar with many different types of water inlet systems that are intended to draw water from a body of water in which the marine propulsion system is operated and conduct that water into one or more conduits which directs the water flow toward a cooling system of an engine used to provide power for the marine propulsion system. The water inlet, or water intake, can be located at various places on the wetted surface of the marine propulsion device.

U.S. Pat. No. 4,752,257, which issued to Karls et al. on Jun. 21, 1988, discloses a cooling water intake with increased flow. The water intake plates covering the water inlet openings have outer forward lips spaced forwardly and outwardly of the water inlet openings and are located outwardly from tapered gear case sections leading to the openings. The water intake plates define with the gear case entrance cavities around the water inlet openings, trapping additional water and directing same inwardly into the water inlet openings for increasing water flow to a transverse passage and to the water pump.

U.S. Pat. No. 4,767,366, which issued to Lang on Aug. 30, 1988, discloses a water ram scoop for a cooling water intake. The marine propulsion system is provided with water intake scoops for increasing the flow of water to a water pump. Each scoop is provided with a water-receiving opening leading to a passage provided therein for passing water through the scoop toward the water pump. The head portion of each scoop protrudes from the gear case, and the water receiving opening is spaced outwardly from the gear case to provide an active water pickup from the flow of water past the gear case.

U.S. Pat. No. 4,832,635, which issued to McCormick on May 2, 1989, discloses a nose construction for the gear case of a marine drive. The drive unit includes a lower propeller torpedo housing of generally cylindrical configuration having a longitudinal centerline. A propeller shaft is mounted in the housing for rotation on an axis offset from the centerline. The shaft is journalled in a forward bearing assembly which is held in place by a support adjustably mounted to the housing and on the offset axis. A nose is removably secured to the forward housing end by a mounting bolt which extends into the support of the offset axis. A single multipurpose opening or port in the forward end of the nose communicates to an interior entry passage in the nose. The entry passage in turn merges into a pair of passage branches. One branch is disposed on the offset propeller shaft axis and receives the mounting bolt. The other branch is positioned to communicate with the cooling water passages in the lower unit, and which lead to the marine drive engine.

U.S. Pat. No. 4,861,293, which issued to McGowan et al. on Aug. 29, 1989, describes a marine propulsion device with a screened water inlet. It comprises side surfaces which include a cooling water inlet comprising an opening located in one side surface, communicating with the interior passage, and defined by forward and rearward walls.

U.S. Pat. No. 4,954,109, which issued to McMorries on Sep. 4, 1990, discloses a water pickup insert. The drive unit includes an outdrive housing having a cooling water passage defined therein with first and second cooling water inlet openings defined on opposite sides of the housing and communicated with the passage. An exterior surface of the housing has first and second recesses defined therein by first and second recessed shoulders adjacent the first and second cooling water inlets. First and second inserts are received within the first and second recesses and abut the respective recessed shoulders.

U.S. Pat. No. 5,098,322, which issued to Higby on Mar. 24, 1992, describes a marine propulsion device with a self-cleaning coolant water inlet screen. It comprises first and second water inlet openings respectively located on first and second sides of the marine propulsion lower unit. It also comprises a water passage including a laterally extending branch extending between the first and second water inlet openings and first and second water inlet screen members including respective water inlet screen portions extending across the first and second water inlet openings. It also comprises respective first and second portions extending integrally from the water inlet screen portions and having releasable inter-engaging mechanisms for retaining the water inlet screen portions in the water inlet openings.

U.S. Pat. No. 5,215,487, which issued to Gruber on Jun. 1, 1993, describes a marine propulsion device water inlet screen. It comprises a water inlet and has an outer surface which extends generally in the fore and aft direction and which includes a ramped portion having a forward end and sloping rearwardly and outwardly from the inlet. It also has a forwardly facing portion partially defining the inlet and extending inwardly from the forward end of the ramped portion. A water inlet screen covers the inlet and includes an inner surface which slopes rearwardly and outwardly. It also engages the ramped surface portion of the housing.

U.S. Pat. No. 5,340,345, which issued to Brodbeck et al. on Aug. 23, 1994, describes a water pickup and cooling apparatus for boat drive systems. It comprises a water pickup for gathering water from the body of water in which the boat is operating and a spray nozzle that directs a stream of cooling water towards the outer surface of the housing containing the drive assembly gears and shafts. The drive assembly of a typical sterndrive for a boat is the linkage that transmits the power generated by the engine to the propeller. To remove the excess frictional heat generated within the drive assembly under high horsepower conditions, the cooling apparatus collects water through a water intake opening when the boat is moving forward through the water.

U.S. Pat. No. 5,376,031, which issued to Meisenburg et al. on Dec. 27, 1994, discloses a marine drive with a surfacing torpedo. The drive has two counter-rotating surface operating propellers. The housing includes a skeg extending downwardly from the lower zone of the torpedo portion, the skeg having a leading edge. A cooling water inlet is located on side surfaces of the skeg.

U.S. Pat. No. 5,536,188, which issued Porta on Jul. 16, 1996, describes a nose cone method and apparatus. A nose cone attachment for an outboard motor propeller gear case has a molded polymer housing shaped to fit over the front and sides of the outboard propeller gear case and has an aerodynamic nose piece shape on the front thereof with a plurality of water inlets thereon. The molded polymer housing has open water channels or plenums thereinside which form wide passageways with the gear case housing sides when the nose cone attachment is attached over the gear case housing. The open water channels are positioned to fit over the gear case water inlets.

U.S. Pat. No. 5,766,046, which issued to Ogino on Jun. 16, 1998, describes a cooling water pickup for a marine propulsion unit. The water pickup arrangement is intended to pick up cooling water for the propelling, water-cooled internal combustion engine. The lower unit has a bullet shaped portion and the water inlet openings are formed on the forward and upper ends of this portion.

U.S. Pat. No. 5,772,481, which issued to Alexander, et al. on Jun. 30, 1998, discloses a skeg construction for a marine propulsion unit. A skeg assembly for a marine propulsion unit includes a generally U-shaped saddle that is removably attached to the lower torpedo section of the gear case of the propulsion unit, and a thin wedge-shaped skeg extends downwardly from the saddle. During planing conditions of the boat, the water line is slightly below the lower torpedo section so that the saddle is out of the water. The side surfaces of the skeg have opposed water intake openings each of which is bordered rearwardly by a laterally projecting shoulder that terminates in a sharp vertical edge and intake openings are bordered forwardly by a curved surface that connects the side surfaces of the skeg. The water intake openings communicate with a water passage in the skeg which, in turn, communicates with a water passage in the torpedo section so that water can be delivered to the cooling system of the propulsion unit.

U.S. Pat. No. 6,146,223, which issued to Karls et al. on Nov. 14, 2000, discloses a marine propulsion unit with water inlets in all four quadrants of the front portion of its torpedo-shape gear case. The water inlet system comprises at least a plurality of frontal inlet openings at the tapered forward end of a gear case portion of a housing structure. The water inlet system can be provided for an outboard motor or a sterndrive unit. Additional water flow can be provided through side inlets formed in the housing structure of the marine propulsion device where both the frontal inlet openings and side inlet openings are connected with fluid communication with the water pump mounted within the housing structure.

The patents described above are hereby expressly incorporated by reference in the description of the present invention.

Certain marine propulsion systems are intended to be operated with surfacing propellers and with gear cases that are at least partially located above the surface of the body of water in which the marine vessel is operated. When a marine propulsion system is operated under the circumstances, water inlets can sometimes be deprived of sufficient water flow to adequately provide cooling water for the engine. When the water inlets are placed at a low position relative to the gear case, they can become fouled with debris when the marine propulsion device is operated in shallow water. It would therefore be significantly beneficial if a water inlet system could be provided that includes a water inlet which is at a location that is relatively low in comparison to the gear case, but not susceptible to fouling when the marine propulsion system is temporarily grounded in the mud or sand when the marine vessel is operated in shallow water.

SUMMARY OF THE INVENTION

A cooling system for a marine propulsion device, in accordance with a preferred embodiment of the present invention, comprises a drive unit which is at least partially submergible below the surface of a body of water. The drive unit comprises a gear case which is configured to support a propeller shaft for rotation about a propeller axis. A water flow directing device is removably attached to the gear case and a water inlet extends from the water flow directing device in a direction which is generally perpendicular to the propeller axis. The inlet extends radially into a stream of flowing water when the marine propulsion device is operative in propelling a marine vessel. The water inlet is disposed below the propeller axis and proximate an aft end of the gear case. A water passage is formed within the drive unit and is connectable in fluid communication with the water flow directing device to provide a water path from the water inlet to the water passage.

In a particularly preferred embodiment of the present invention, the water inlet extends downwardly beyond an outer surface of the gear case and the water flow directing device is generally annular in shape with an internal annular passage formed therein which is configured to direct the water path from the water inlet to the water passage. The water flow directing device can be attachable to a bearing carrier which is disposed within the gear case of the marine propulsion device. An opening can be formed through an exterior surface of the gear case and connected in fluid communication with the water passage through the internal annular passage.

The water inlet can be formed as an integral part of the water flow directing device or, alternatively, can be attachable to the water flow directing device. In certain embodiments of the present invention, the water flow directing device can comprise two parts which are attached together at a parting surface which is generally perpendicular to the propeller axis. In a preferred embodiment of the present invention, the water inlet is aligned with and disposed behind a skeg of the marine propulsion device.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
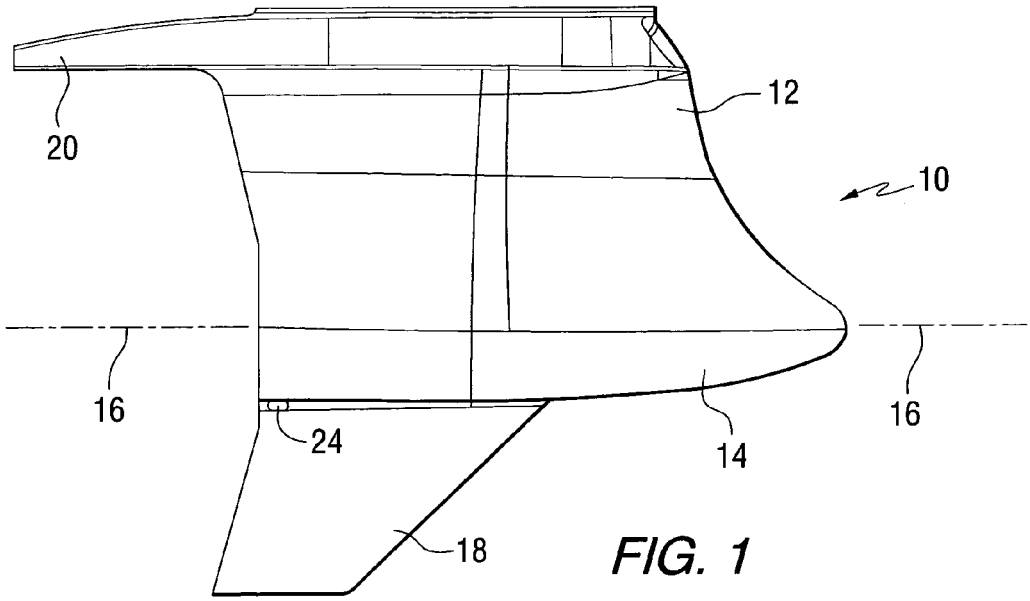
FIG. 1 is a side view of a drive unit of a marine propulsion device.

Throughout the description of the preferred embodiment of the present invention, like components will be identified by like reference numerals.

FIG. 1 shows a drive unit 10 of a marine propulsion device. Those skilled in the art of marine propulsion devices are aware that the drive unit 10, or lower unit, provides support for a driveshaft which is rotatable about a generally vertical axis. The driveshaft (not shown in FIG. 1) extends downwardly through a driveshaft housing 12 and is connected in torque transmitting relation with a propeller shaft (not shown in FIG. 1) which is supported by a gear case 14 for rotation about a generally horizontal axis 16. A skeg 18 is attached to a bottom portion of the gear case 14 and extends downwardly as shown in FIG. 1. An anti-ventilation plate 20 is also illustrated in FIG. 1.

FIG. 1 does not show a propeller or the removably attachable portion of the present invention which will be described in greater detail below. However, FIG. 1 does illustrate an opening 24 which is formed through an exterior surface of the gear case 14 and provides an additional water inlet in certain embodiments of the present invention.

Figure 2:
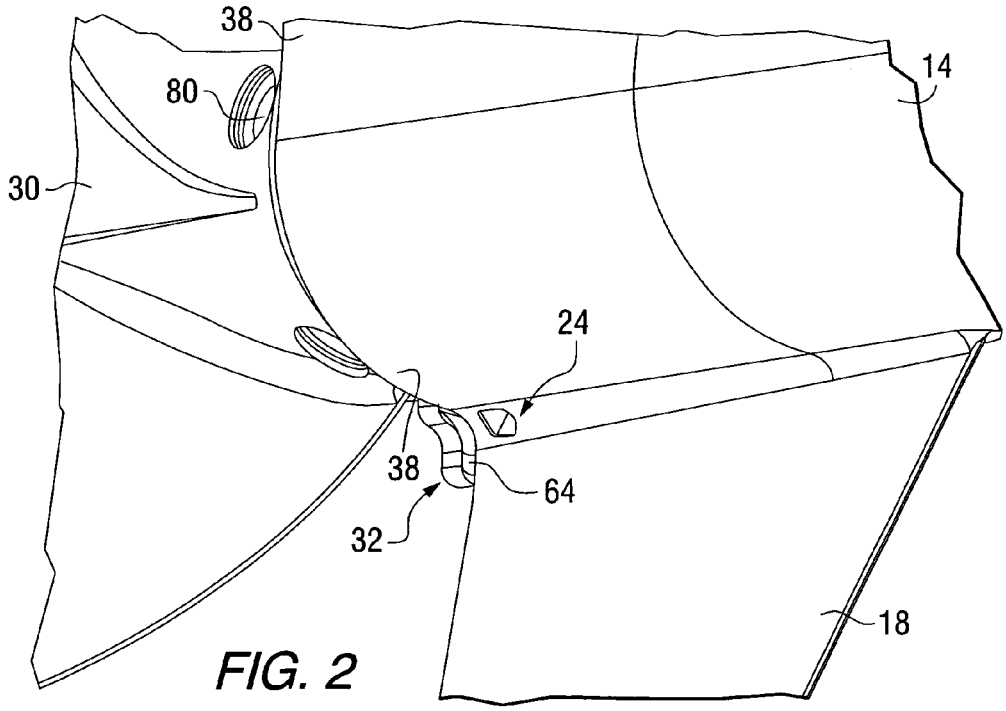
FIG. 2 is an isometric view of a gear case, skeg, and propeller of a marine propulsion device in combination with a preferred embodiment of the present invention.

FIG. 2 is a partial isometric view of the lower portion of a drive unit of a marine propulsion device. In FIG. 2, a propeller 30 is shown supported for rotation about the propeller axis 16 which is described above in FIG. 1. Additionally, the opening 24 is shown formed in a lower portion of the gear case 14. A water inlet 32 of the present invention is illustrated in FIG. 2 at a location which is directly behind the skeg 18 and which extends downwardly in a direction that is generally perpendicular to the propeller axis 16 described in conjunction with FIG. 1. The water inlet extends radially into water through which the marine propulsion device is moving when the marine propulsion device is operative and propelling a marine vessel. As shown in FIG. 2, the water inlet 32 is disposed below the propeller axis (illustrated in FIG. 1, but not shown in the partial isometric view of FIG. 2). In addition, the water inlet 32 is disposed proximate an aft end 38 of the gear case 14.

In a particularly preferred embodiment of the present invention, the water flow directing device comprises two parts which are attached together at a parting surface which is generally perpendicular to a central axis which, when the water flow directing device is attached to the marine propulsion device, is generally coaxial with a propeller axis.

Figure 3:
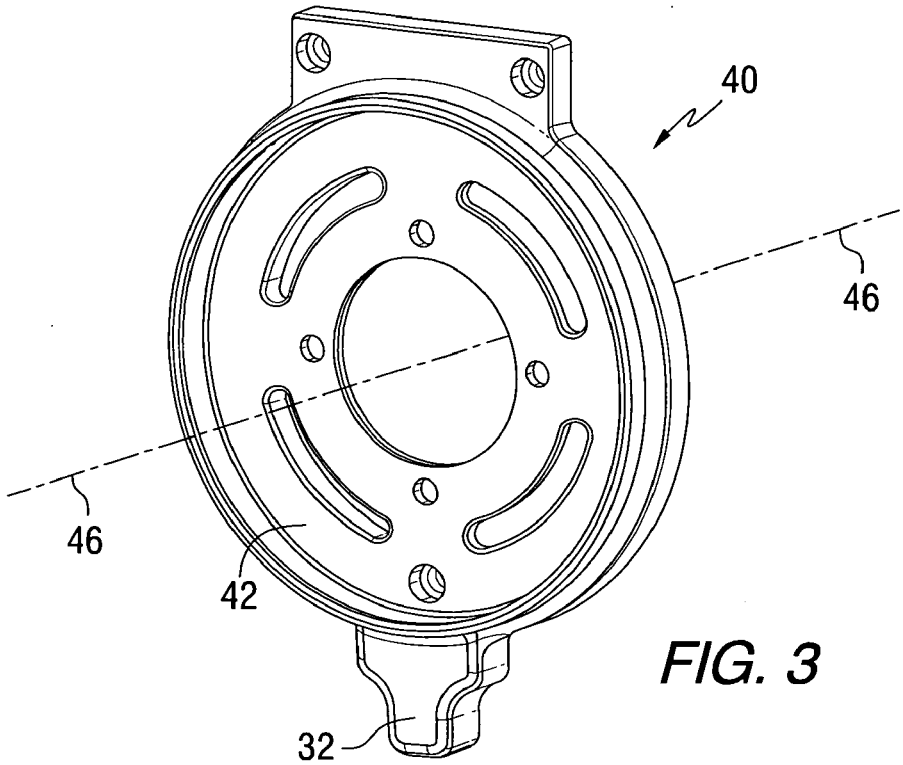
FIGS. 3 and 4 show two isometric views of an aft part of a water flow directing device of a preferred embodiment of the present invention.
Figure 4:
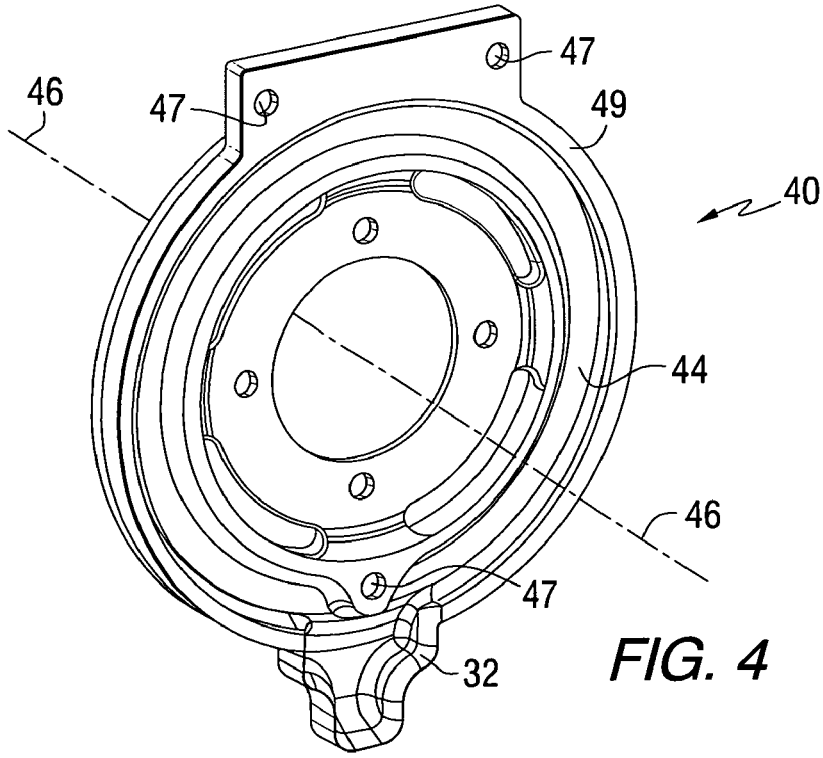

With reference to FIGS. 3 and 4, an aft part 40 is shown in two isometric views. In FIG. 3, an aft surface 42 of the aft part 40 is shown and in FIG. 4, a forward surface 44 is shown. The aft part 40 of the water flow directing device supports the water inlet 32 which extends from the aft part 40 in a generally radial direction with reference to a central axis 46. Reference numeral 49 identifies a parting surface of the aft part 40 which is placed in contact with a forward part of the water flow directing device which will be described in greater detail below.

Figure 5:
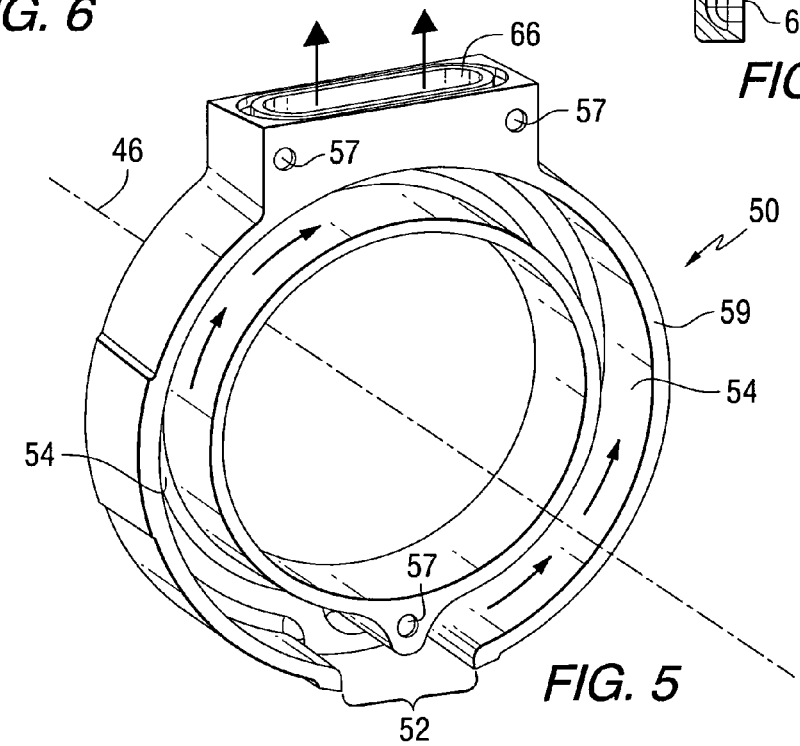
FIG. 5 is an isometric view of a forward part of the water flow directing device in a preferred embodiment of the present invention.

FIG. 5 shows a forward part 50 of the water flow directing device. For purposes of reference, the central axis 46 is also shown in FIG. 5. An opening 52 is alignable with the water inlet 32 described above. The forward part 50 illustrates the generally annular shape of the water flow directing device. An internal annular passage 54 is formed within the water flow directing device and configured to direct a flow of water from the water inlet 32, which is shown in FIGS. 2–4, to a water passage which is formed within the marine propulsion device and which will be described in greater detail below. The water flows upwardly through the internal annular passage 54, as illustrated by the arrows in FIG. 5, and then flows upwardly out of the water flow directing device and into the water passage formed within the marine propulsion device.

With reference to FIGS. 4 and 5, the aft part 40 and the forward part 50 of the water flow directing device are attachable to each other by fasteners which extend through holes 47 and 57. This places the parting surfaces 49 and 59 in coplanar association with each other and places the water inlet 32 proximate the water opening 52.

Figure 6:
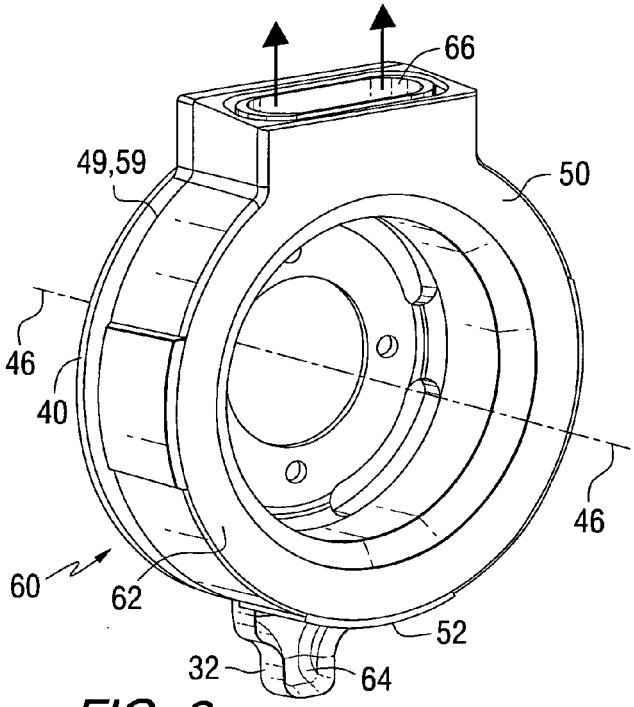
FIG. 6 is an isometric view of an assembled water flow directing device of a preferred embodiment of the present invention.

FIG. 6 is an isometric view of a water flow directing device 60 which comprises the aft part 40 and the forward part 50 which are described above in conjunction with FIGS. 3–5. The two parts of the water flow directing device 60 are assembled together with their parting surfaces, 49 and 59, in coplanar association with each other. The water inlet 32 is shown assembled proximate the opening 52. The internal annular passage 54 is enclosed within the structure shown in FIG. 6. When attached to a marine propulsion device, the surface identified by reference numeral 62 is forward facing. The open face 64 of the water inlet 32 also faces forward so that water is caused to flow into and in fluid communication with the internal annular passage within the water flow directing device 60. As the marine propulsion device moves through the body of water in which it is operating, water is forced into the open surface 64 and out of the opening identified by reference numeral 66 in FIGS. 5 and 6. The flow of water through the internal annular passage 54 is caused to flow under the force of RAM pressure resulting from the movement of the marine propulsion device through the water.

Figure 7:
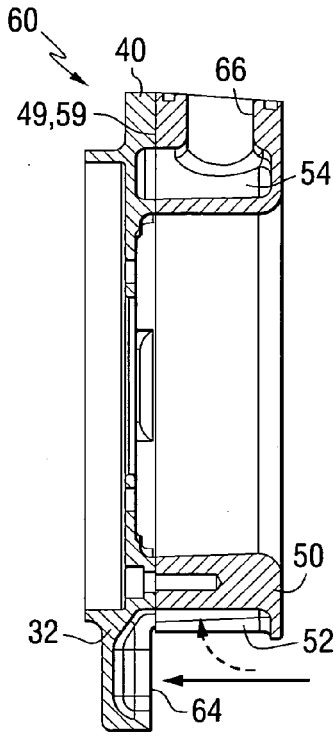
FIG. 7 is a section view of the device illustrated in FIG. 6.

FIG. 7 is a side section view of the water flow directing device 60. The aft part 40 and the forward part 50 are attached together through the use of fasteners extending through the holes described above in conjunction with FIGS. 4 and 5 and identified by reference numerals 47 and 57. It can be seen that the water passage 52 formed in the forward part 56 and the opening 64 of the water inlet 32 are generally proximate each other. As will be described in greater detail below, the water inlet 32 is intended to receive a flow of water, represented by the solid is line arrow in FIG. 7, under RAM pressure resulting from the movement of the marine propulsion device through the water when the marine propulsion device is operating to move a marine vessel. The opening 52 is intended to receive water through the opening 24 which is described above in conjunction with FIG. 1 when the marine propulsion device is operating at a relatively low speed. Both of these alternative water receiving openings are connected in fluid communication with the internal annular passage 54 of the water flow directing device 60.

Figure 8:
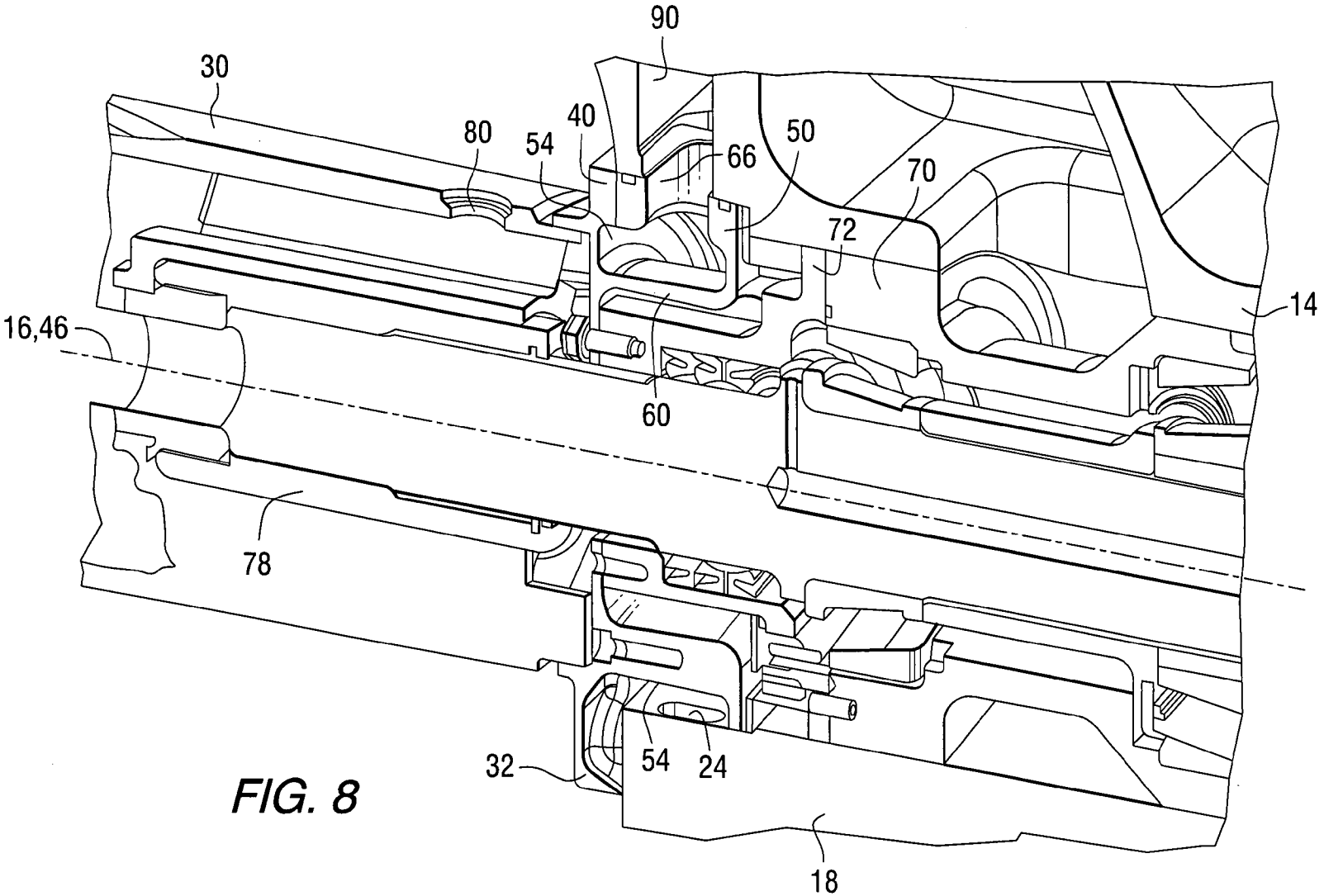
FIG. 8 is a section view of an isometric illustration of a preferred embodiment of the present invention disposed within an internal cavity of a gear case of a marine propulsion system.

FIG. 8 is a section view of an isometric illustration showing the water flow directing device, which comprises the aft part 40 and the forward part 50, disposed within the structure of a gear case 14. The water inlet 32 is shown directly behind the skeg 18. Although not shown in FIG. 8, it should be understood that the water inlet is configured to extend in the port and starboard directions beyond the structure of the skeg 18 so that it receives water flowing along the side surfaces of the skeg 18 and below the gear case 14. The opening 24 is shown disposed in fluid communication with the internal annular passage 54 of the forward part 50. A bearing carrier 70 is disposed within the internal cavity of the gear case 14. A seal carrier 72 is attached to the bearing carrier 70. The water flow directing device 60 is attached to the seal carrier 72. Reference numeral 78 identifies a propeller shaft. The central axis 46 and the propeller axis 16 are coaxial in FIG. 8. The propeller 30 is represented by its propeller hub in FIG. 8 and the blades of the propeller are not shown. For purposes of reference, the vent openings 80 provide a positional reference with respect to FIGS. 2 and 8. A water passage 90 is provided within the marine propulsion device to direct water flowing from the opening 66 formed in the upper portion of the water flow directing device 60.

Figure 9:
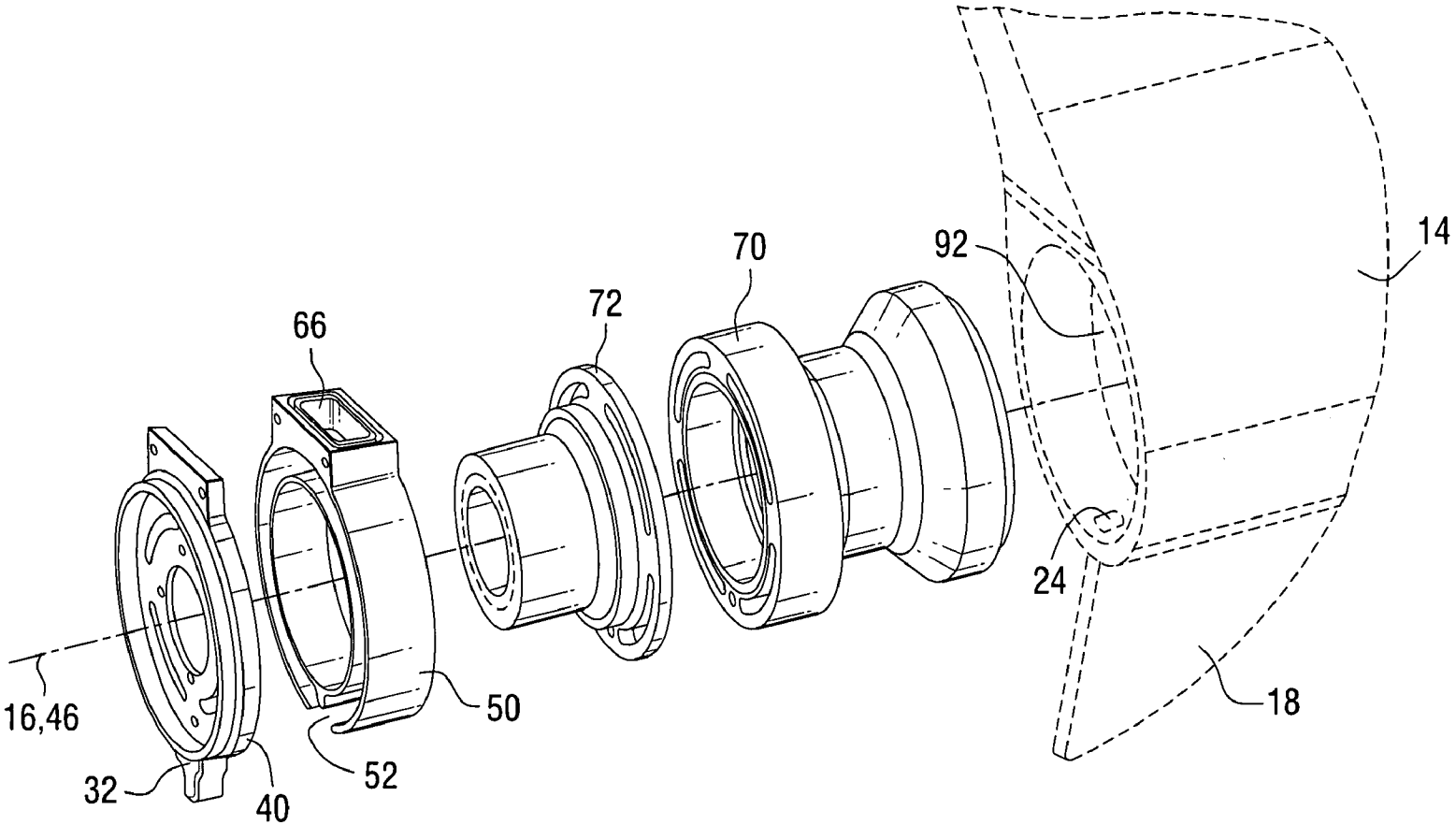
FIG. 9 is an exploded isometric view of the water flow directing device of a preferred embodiment of the present invention.

FIG. 9 is an exploded view of the internal components which are located within the internal cavity 92 of the gear case 14 which is represented by dashed lines in FIG. 9. In the exploded view, the aft part 40 and the forward part 50 are is shown relative to the seal carrier 72 and the bearing carrier 70 with which those skilled in the art are thoroughly familiar. The components illustrated by solid line in FIG. 9 are arranged in relation to the coaxial central axis 46 and propeller axis 16 which are described above. The skeg 18, gear case 14, opening 24, and internal cavity 92 of the marine propulsion device are shown in dashed line representation in FIG. 9.

With reference to FIGS. 1–9, it can be seen that the preferred embodiment of the present invention provides a significant benefit by locating the water inlet 32 at a location which is both below and behind the gear case 14. This places the inlet 32 at a position where it can have access to a supply of water even when the marine drive unit is trimmed upwardly so that a portion of the gear case 14 is above the surface of the body of water in which the marine propulsion device is operating. In addition, the location of the inlet 32 significantly decreases the likelihood that it will ingest debris, such as mud or sand, when the marine propulsion device is operated in shallow water. When the marine propulsion device is operated at relatively slow speeds, water can be drawn through opening 24 in addition to the water which is drawn through the open face 64 of the water inlet 32.

With continued reference to FIGS. 1–9, it can be seen that a preferred embodiment of the present invention comprises a drive unit 10 which is at least partially submergible below the surface of the body of water. The drive unit comprises a gear case 14 which is configured to support a propeller shaft 78 for rotation about a propeller axis 16. A water flow directing device 60 is removably attachable to the gear case 14. A water inlet 32 extends from the water flow directing device 60 in a direction which is generally perpendicular to the propeller axis 16. The inlet 32 extends radially into water through which the marine propulsion device is moving when the marine propulsion device is operative in propelling a marine vessel. The water inlet 32 is disposed below the propeller axis 16 and proximate an aft end of the gear case 14. A water passage 90 is formed within the drive unit 10 and is connectable in fluid communication with an opening 66 of the water flow directing device 60 in order to provide a water path from the water inlet 32 to the water passage 90. The water inlet 32 extends downwardly beyond an outer surface of the gear case 14 in a preferred embodiment of the present invention. The water flow directing device 60 can be generally annular in shape with an internal annular passage 54 formed therein which is configured to direct the water path from the water inlet 32 to the water passage 90. The water flow directing device 60 can be attachable to a bearing carrier 70 which is disposed within the gear case 14. In a preferred embodiment of the present invention, the water flow directing device 60 is attached to the bearing carrier 70 through the intermediate position of a seal carrier 72. An opening 24 formed through an exterior surface of the gear case 14 is connected in fluid communication with the water passage 90 in a preferred embodiment of the present invention in order to provide an additional fluid passageway for use when the marine propulsion device is operating at relatively slow speeds. The water inlet 32 is formed as an integral part of the water flow directing device 60 in a preferred embodiment of the present invention. As described above, the water flow directing device 60 can comprise an aft part 40 and a forward part 50 which are attached together at a parting surface, 49 and 59, which is generally perpendicular to the propeller axis 16 and the central axis 46. The water inlet 32 can be aligned with and disposed behind a skeg 18 of the marine propulsion device. As described above, the water inlet 32 can extend from the water flow directing device 60 in a direction which is generally perpendicular to a central axis about which the generally annular water flow directing device is coaxial.

Although the present invention has been described in considerable detail and illustrated to show a preferred embodiment, it should be understood that alternative embodiments are also within its scope.

We claim:

1. A cooling system for a marine propulsion device, comprising:

a drive unit which is at least partially submergible below the surface of a body of water, said drive unit comprising a gear case which is configured to support a propeller shaft for rotation about a propeller axis;

a water flow directing device which is removably attached to said gear case;

a water inlet extending from said water flow directing device, said water inlet being aligned with and disposed directly behind a skeg of said marine propulsion device, said water inlet extending into water, on both the port and starboard sides of said skeg, through which said marine propulsion device is moving when said marine propulsion device is operative in propelling a marine vessel, said water inlet being disposed below and proximate an aft end of said gear case; and a water passage formed within said drive unit, said water passage being connectable in fluid communication with said water flow directing device to provide a water path from said water inlet to said water passage.

2. The cooling system of claim 1, wherein:

said water flow directing device is generally annular in shape with an internal annular passage formed therein which is configured to direct said water path from said water inlet to said water passage.

3. The cooling system of claim 1, wherein:

said water flow directing device is attachable to a bearing carrier which is disposed within said gear case.

4. The cooling system of claim 1, further comprising:

an opening formed through an exterior surface of said gear case and connected in fluid communication with said water passage.

5. The cooling system of claim 1, wherein:

said water inlet is formed as an integral part of said water flow directing device.

6. The cooling system of claim 1, wherein:

said water flow directing device comprises two parts which are attached together at a parting surface which is generally perpendicular to said propeller axis.

7. The cooling system of claim 1, wherein:

said water inlet extends from said water flow directing device in a direction which is generally perpendicular to said propeller axis.

8. The cooling system of claim 1, wherein:

said water inlet extends radially into said water through which said marine propulsion device is moving.

9. A cooling system for a marine propulsion device, comprising:

a drive unit which is at least partially submergible below the surface of a body of water, said drive unit comprising a driveshaft housing, a gear case which is attached for support to a lower portion of said drive shaft housing and which is configured to support a propeller shaft for rotation about a generally horizontal propeller axis;

a water flow directing device which is removably attached to an aft end of said gear case;

a water inlet extending from said water flow directing device in a direction which is generally downward and generally perpendicular to said propeller axis, said water inlet being aligned with and disposed directly behind a skeg of said marine propulsion device and on both the port and starboard sides of said skeg, said water inlet extending radially beyond said gear case, said water inlet being disposed below and proximate an aft end of said gear case; and a water passage formed within said drive unit, said water passage being connectable in fluid communication with said water flow directing device to provide a water path from said water inlet to said water passage.

10. The cooling system of claim 9, further comprising:

a bearing carrier disposed within said gear case, said water flow directing device being attachable to said bearing carrier.

11. The cooling system of claim 9, wherein:

said water flow directing device is generally annular in shape with an internal annular passage formed therein which is configured to direct said water path from said water inlet to said water passage.

12. The cooling system of claim 9, further comprising:

an opening formed through an exterior surface of said gear case and connected in fluid communication with said water passage.

13. The cooling system of claim 9, wherein:

said water inlet is formed as an integral part of said water flow directing device.

14. The cooling system of claim 9, wherein:

said water flow directing device comprises two parts which are attached together at a parting surface which is generally perpendicular to said propeller axis.

15. A cooling system for a marine propulsion device, comprising:

a water flow directing device which is removably attachable to said marine propulsion device, said water flow directing device comprising an internal water conduit which is generally annular in shape and generally coaxial with a central axis; and a water inlet extending from said water flow directing device in a direction which is generally perpendicular to said central axis said water inlet being aligned with and disposed directly behind a skeg of said marine propulsion device, said water inlet being shaped to extend radially into water, on both the port and starboard sides of said skeg, through which said marine propulsion device is moving when said water flow directing device is attached to said marine propulsion device and said marine propulsion device is operative in propelling a marine vessel, said water inlet being disposable below said central axis, said water inlet extending downwardly beyond an outer surface of said gear case.

16. The cooling system of claim 15, further comprising:

a drive unit which comprises a gear case which is configured to support a propeller shaft for rotation about a propeller axis; and a water passage formed within said drive unit, said water passage being connectable in fluid communication with said water flow directing device to provide a water path from said water inlet to said water passage.

17. The cooling system of claim 16, wherein:

said central axis and said propeller axis are coaxial.

18. The cooling system of claim 17, wherein:

said internal water conduit of said water flow directing device is configured to direct said water path from said water inlet to said water passage.

19. The cooling system of claim 18, wherein:

said water flow directing device is attachable to a bearing carrier which is disposed within said gear case.

20. The cooling system of claim 19, further comprising:

an opening formed through an exterior surface of said gear case and connected in fluid communication with said water passage.

* * * * *